US009314848B2

(12) United States Patent
Larsson

(10) Patent No.: US 9,314,848 B2
(45) Date of Patent: Apr. 19, 2016

(54) IRON BASED POWDERS FOR POWDER INJECTION MOLDING

(75) Inventor: Anna Larsson, Kvidinge (SE)

(73) Assignee: HOGANAS AB (PUBL), Hoganas (SE)

( * ) Notice: Subject to any disclaimer, the term of this patent is extended or adjusted under 35 U.S.C. 154(b) by 501 days.

(21) Appl. No.: 13/997,863

(22) PCT Filed: Dec. 29, 2011

(86) PCT No.: PCT/EP2011/074230
§ 371 (c)(1),
(2), (4) Date: Jun. 25, 2013

(87) PCT Pub. No.: WO2012/089807
PCT Pub. Date: Jul. 5, 2012

(65) Prior Publication Data

US 2013/0302202 A1 Nov. 14, 2013

Related U.S. Application Data

(60) Provisional application No. 61/431,269, filed on Jan. 10, 2011.

(30) Foreign Application Priority Data

Dec. 30, 2010 (SE) ..... 1051396

(51) Int. Cl.

| | |
|---|---|
| ***B22F 1/00*** | (2006.01) |
| ***B22F 3/26*** | (2006.01) |
| ***C22C 33/02*** | (2006.01) |
| ***B22F 3/12*** | (2006.01) |
| ***B22F 3/24*** | (2006.01) |

(52) U.S. Cl.
CPC ..... *B22F 3/26* (2013.01); *B22F 1/0003* (2013.01); *B22F 3/12* (2013.01); *B22F 3/24* (2013.01); *C22C 33/0214* (2013.01); *C22C 33/0264* (2013.01)

(58) Field of Classification Search
CPC ..... B22F 1/0003
See application file for complete search history.

(56) References Cited

U.S. PATENT DOCUMENTS

| | | | |
|---|---|---|---|
| 5,091,022 | A | 2/1992 | Achikita et al. |
| 5,516,483 | A | 5/1996 | Shivanath et al. |
| 5,918,293 | A | 6/1999 | Lindberg et al. |
| 5,993,507 | A | 11/1999 | Baum et al. |
| 2008/0233421 | A1 | 9/2008 | Tanino et al. |

FOREIGN PATENT DOCUMENTS

| | | | |
|---|---|---|---|
| WO | WO 91/19582 | A1 | 12/1991 |
| WO | WO 95/21275 | A1 | 8/1995 |
| WO | WO 98/16666 | A1 | 4/1998 |

OTHER PUBLICATIONS

International Search Report (PCT/ISA/210) issued on Jun. 20, 2012, by the European Patent Office as the International Searching Authority for International Application No. PCT/EP2011/074230.
Written Opinion (PCT/ISA/237) issued on Jun. 20, 2012, by the European Patent Office as the International Searching Authority for International Application No. PCT/EP2011/074230.

*Primary Examiner* — Jessee Roe
*Assistant Examiner* — Ngoclan T Mai
(74) *Attorney, Agent, or Firm* — Buchanan Ingersoll & Rooney P.C.

(57) ABSTRACT

An iron-based powder composition for metal injection molding having an average particle size of 20-60 μm, and having 99% of the particles less than 120 μm wherein the iron-based powder composition includes, by weight percent of the iron-based powder composition: Mo: 0.3-1.6, P: 0.1-0.6, optionally Cu: up to 3.0, optionally Si: up to 0.6, optionally Cr: up to 5, optionally, unavoidable impurities: up to 1.0, whereof carbon is less than 0.1, the balance being iron, and wherein the sum of Mo and 8*P content is within the range of 2-4.7.

14 Claims, 4 Drawing Sheets

IRON BASED POWDERS FOR POWDER INJECTION MOLDING

FIELD OF THE INVENTION

The present invention concerns an iron-based powder composition for powder injection molding, the method of making sintered components from the powder composition, and sintered components made from the powder composition. The powder composition is designed to obtain sintered parts with densities above 93% of the theoretical density, combined with optimized mechanical properties.

BACKGROUND OF THE INVENTION

Metal Injection Moulding (MIM) is an interesting technique for producing high density sintered components of complex shapes. In general fine carbonyl iron powders are used in this process. Other types of powders used are gas atomized and water atomized of very fine particle size. However, the cost of these fine powders is relatively high. In order to improve the competitiveness of the MIM process it is desirable to reduce the cost of the powder used. One way of achieving this, is by utilizing coarser powders. However, coarse powders have a lower surface energy than fine powders and are thus much less active during sintering. Another issue is that coarser and irregular powders have a lower packing density and thus the maximal powder content of the feedstock is limited. A lower powder content results in a higher shrinkage during sintering and may lead to inter alia in high dimensional scatter between components produced in a production run.

Literature suggests reducing the amount of carbonyl iron by adding certain amount of coarser iron powder and optimizing the mixing ratio, in order not to lose too much sinterability and pack density. Another way to increase sinterability is by adding ferrite phase stabilizers such as Mo, W, Si, Cr and P. Additions of 2-6% Mo, 2-4% Si or up to 1% P to mixes of atomized and carbonyl iron have been mentioned in literature.

U.S. Pat. No. 5,993,507 discloses blended coarse and fine powders compositions containing silicon and molybdenum. The composition comprises up to about 50% coarse powder and the Mo+Si—content varies from 3-5%.

U.S. Pat. No. 5,091,022 discloses a method of manufacturing a sintered Fe—P powdered metal product having high magnetic permeability and excellent soft magnetic characteristics, using injection molding with carbonyl iron below 5 μm.

U.S. Pat. No. 5,918,293 discloses an iron based powder for compacting and sintering containing Mo and P.

Normally the solid loading (i.e. the portion of iron-based powder) of an iron-based MIM feedstock (i.e. the iron-based powder mixed with organic binder ready to be injected) is about 50% by volume which means that in order to reach high density after sintering (above 93% of theoretical density) the green component must shrink almost by 50% by volume, in contrast to PM components produced through uniaxial compaction which already in green state obtain relatively high density. Therefore fine powders having high sintering activity are normally used in MIM. By elevating the sintering temperature coarser powders may be used, a drawback however with using elevated sintering temperatures is that grain coarsening may be obtained and hence lower impact strength. The present invention provides a solution for this problem.

It has unexpectedly been found that a feedstock comprising coarse iron-based atomized powder composition according to the invention, with a relatively low total amount of ferrite stabilizers, can be used for powder injection molding in order to obtain components with a sintered density of at least 93% of the theoretical density. Further, it has been noticed that apart from obtaining components having a sintered density above 93%, a surprisingly high toughness, impact strength, can be obtained if the powder contains a specified amount of molybdenum and phosphorous and have a certain metallographic structure.

OBJECTS OF THE INVENTION

One objects of the invention are to provide a relatively coarse iron based powder composition having low amounts of alloying elements, and that is suitable for metal injection moulding.

Another object of invention is to provide a metal injection molding feedstock composition comprising said a relatively coarse iron based powder composition having low amounts of alloying elements, and that is suitable for metal injection moulding.

Another object of the invention is to provide a method for producing injection molded sintered components from the feedstock composition having a density of 93% and above, of the theoretical density.

Still another object of the present invention is to provide a sintered component produced according to the MIM process having a density of 93% and above, of theoretical density and impact strength above 50 J/cm$^2$ and tensile strength above 350 MPa

SUMMARY OF THE INVENTION

At least one of these objects is accomplished by:

An iron based powder composition for metal injection moulding having an average particle size of 20-60 μm, preferably 20-50 μm, most preferably 25-45 μm, and including a phosphorus containing powder, such as $Fe_3P$.

A metal injection molding feedstock composition comprising atomized iron-based powder composition with an average particle size of 20-60 μm, preferably 20-50 μm, most preferably 25-45 μm, and an organic binder. Said iron-based powder composition including a phosphorus containing powder, such as $Fe_3P$ A method for producing a sintered component comprising the steps of:

a) preparing a metal injection molding feedstock as suggested above, b) molding the feedstock into an unsintered blank, c) removing the organic binder d) sintering the obtained blank in a reducing atmosphere at a temperature between 1200-1400° C. in the ferrite region (BCC)

e) cooling the sintered component through a two phase area of austenite and ferrite to provide the formation of austenite grains (FCC) at the grain boundaries of the ferrite grains, and f) optionally subjecting the component to post sintering treatment such as case hardening, nitriding, carburizing, nitrocarburizing, carbonitriding, induction hardening, surface rolling and/or shot peening.

Preferably when passed the two phase area the cooling rate should be at least 0.2° C./s, more preferably at least 0.5° C./s until a temperature of about 400° C. has been reached, in order to suppress grain growth.

A sintered component made from the feedstock composition. The component having a density of at least 93% of theoretical density, an impact strength above 50 J/cm$^2$ tensile strength above 350 MPa, and a ferritic microstructure containing grains having a higher phosphorous content than the nominal phosphorus content (average P—content of the component) that are embedded in grains having a phosphorous content lower that the nominal phosphorous content. The grains having lower phosphorous content being formed from transformed austenite grains.

DETAILED DESCRIPTION OF THE INVENTION

Iron-Based Powder Composition

The iron based powder composition includes at least one iron based powder and/or pure iron powder. The iron based powder and/or pure iron powder can be produced by water or gas atomization of an iron melt and optionally alloying elements. The atomized powder can further be subjected to a reduction annealing process, and optionally be furthered alloyed by using a diffusion alloying process. Alternatively, iron powder may be produced by reduction of iron-oxides.

The particle size of the iron- or iron-based powder composition is such that the mean particle size is of 20-60 μm, preferably 20-50 μm, most preferably 25-45 μm. Further it is preferred $D_{99}$ shall be at most 120 μm, preferably at most 100 μm. ($D_{99}$ means that 99% by weight of the powder have a particle size less than $D_{99}$)

Molybdenum may be added as an alloying element in the form of molybdenum powder, ferromolybdenum powder or as another molybdenum-alloy powder, to the melt prior to atomization, thus forming a pre-alloyed powder. Molybdenum may also be diffusion bonded onto the surface of the iron powder by a thermal diffusion bonding process. As an example molybdenum trioxide can be mixed with an iron powder and thereafter subjected to a reduction process forming the diffusion bonded powder. Molybdenum, in the form of molybdenum powder, ferromolybdenum powder or as another molybdenum-alloy powder may also be mixed with a pure iron-powder. Combination of these methods may also be applied. In the case a molybdenum containing powder is admixed to the iron or iron-based powder the particle size of the molybdenum containing powder shall never be higher than that of the iron or iron-based powder.

The iron based powder composition further includes a phosphorus containing powder and optionally powders containing silicon and/or copper and/or other ferrite stabilizing elements such as chromium. In case of chromium the content may be up to 5% by weight of the powder composition. The particle size of the phosphorus containing powder or powders containing silicon and/or copper and/or other ferrite stabilizing elements such as chromium should preferably never be higher than that of the iron or iron-based powder.

Phosphorus and Molybdenum stabilizes the ferrite structure, the BCC—(Body Centered Cubic) structure. Self diffusion rate of iron atoms is approximately 100 times higher in the ferrite structure compared to the rate in the austenite structure, the FCC—(Face Centered Cubic) structure and thus sintering times can drastically be reduced when sintering is performed in the ferrite phase.

However prolonged sintering at high temperature in the ferrite phase will cause excessive grain growth thus negatively influence inter alia impact strength. Provided that the phosphorus content and the molybdenum content is kept within certain limits, FCC grains will form on the grain boundaries of the BCC grains causing a refinement of the grain structure upon cooling.

Figure 1:
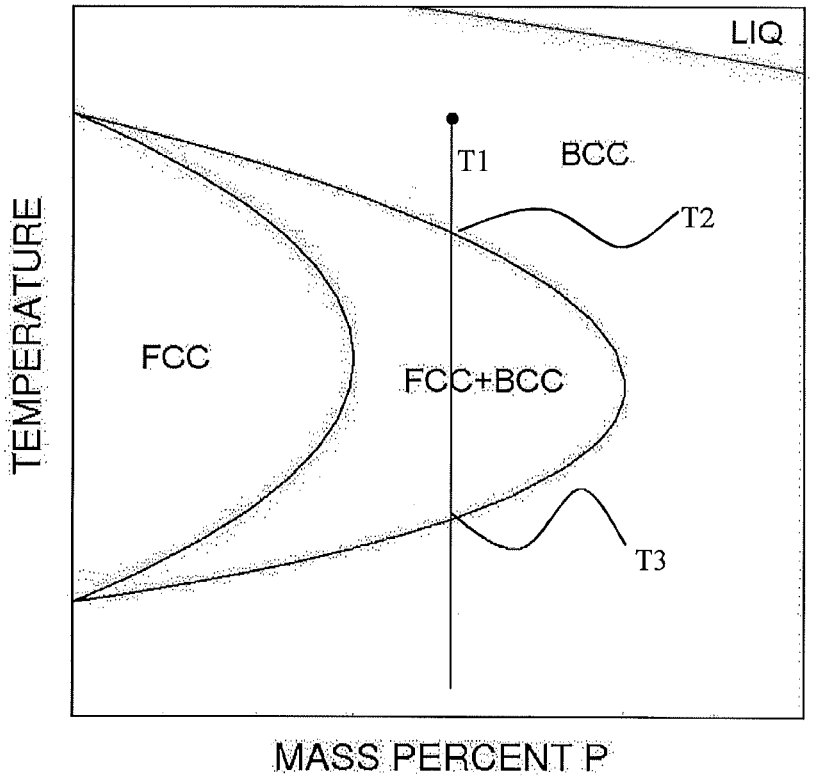
FIG. 1 shows the principal cooling path for component made from the composition according to an embodiment of the present invention.
Figure 2:
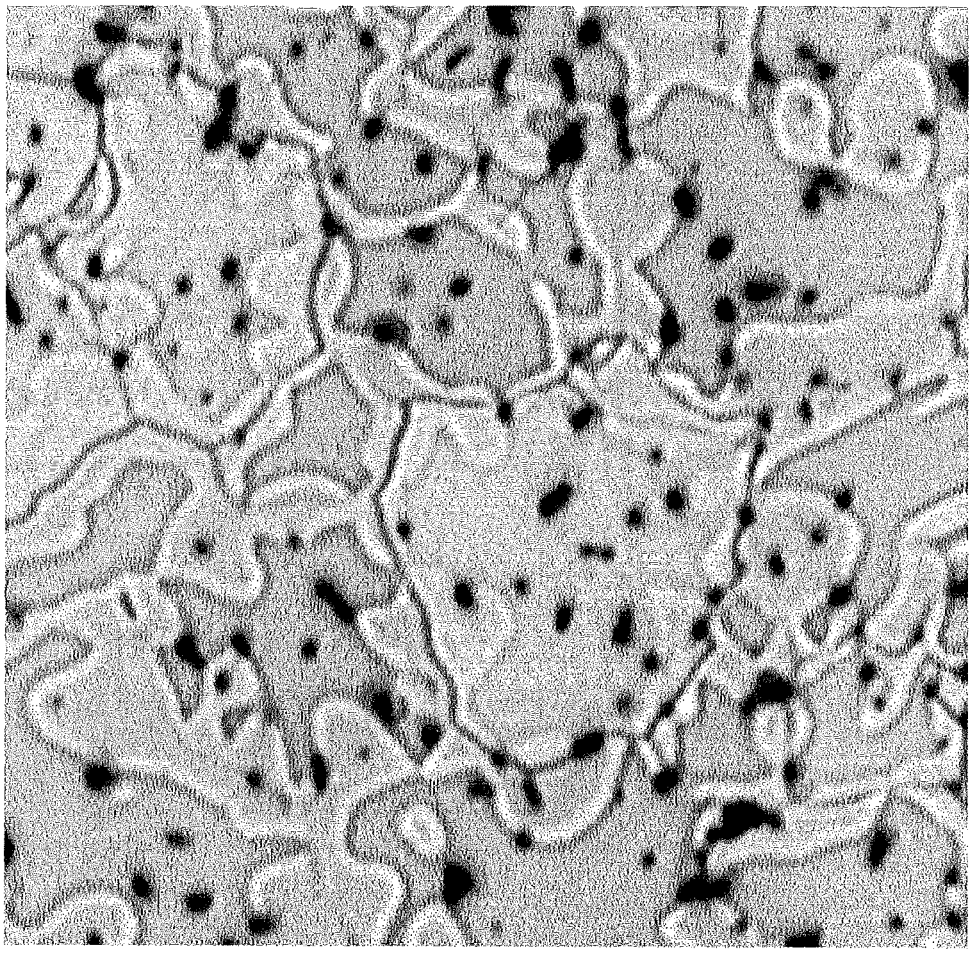
FIG. 2 shows a metallographic structure.

FIG. 1 shows the principal cooling path for component made from the composition according to the present invention. Sintering is performed in the BCC area as indicated by T1, while during cooling the sintered component must pass through the two phase area, BCC/FCC, i.e. between temperatures T2 and T3. When the component has passed the two phase area the further cooling is performed at a relatively high cooling rate, high enough in order to avoid grain coarsening. Preferably the cooling rate below the two phase area (T2-T3) is above 0.2° C./seconds, more preferably above 0.5° C./seconds until a temperature of about 400° C. has been reached. The resulting metallographic structure is shown in FIG. 2. At room temperature a component according to the invention will have a metallographic structure consisting of two types of ferrite grains. In FIG. 2 is shown a network of lighter grains that were formed during cooling through the two phase area. These grains were austenitic in the two phase area and thus have a lower phosphorous content then the grains that they surround that remained ferritic during the whole cooling process. The grains that were formed when the material passed through the two phase area will have lower phosphorus content and the grains that were ferritic at the sintering temperature will have higher phosphorus content.

Molybdenum has the effect of pushing the two phase area in FIG. 1 to the left and also to diminish the two phase area both in horizontal and vertical direction. That means that increased molybdenum content will lower the minimum sintering temperature in order to sinter in the ferritic region and decrease the amount of phosphorous needed in order to cool through the two phase area.

The total content of Mo in the powder should be between 0.3-1.60 wt %, preferably 0.35-1.55 wt %, and even more preferably 0.40-1.50 wt %.

A content above 1.60% molybdenum will not contribute to increased density at sintering but only increase cost of the powder and will also make the two phase area too small, i.e. it will be hard to provide the desired microstructure of ferritic grains with high phosphor content surrounded by ferritic grains with lower phosphor content that has been transformed from austenitic grains formed in the two phase area. A content of molybdenum below 0.3% will increase the risk of creating unwanted metallographic structures, thus negatively influence mechanical properties such as impact strength.

Phosphorus is admixed to the iron based powder composition in order to stabilize the ferrite phase, but also to induce so-called liquid phase and thus promote sintering. The addition is preferably made in the form of fine $Fe_3P$-powder, with an average particle size below 20 μm. However, P should always be in the region of 0.1-0.6 wt %, preferably 0.1-0.45 wt %, more preferably 0.1-0.40% by weight of the iron based composition. Other P containing substances such as $Fe_2P$ may also be used. Alternatively, the iron or iron-based powder may be coated with a phosphorous containing coating.

The total content of P is depending on the Mo-content in the powder composition as described above. Preferably the combined content of molybdenum and phosphorus shall be according to the following formula:

Mo wt %+8*P wt %=2-4.7,preferably 2.4-4.7 wt %

Silicon (Si) may optionally be included in the iron based powder composition as a prealloyed or diffusion-bonded element to an iron based powder in the iron based powder composition, alternatively as a powder mixed to the iron based powder composition. If included the contents should not be more than 0.6% by weight, preferably below 0.4 wt % and more preferably below 0.3 wt %. Silicon reduces the melting point of the molten steel before atomization, thus facilitating the atomization process. A content of silicon above 0.6 wt % will negatively influence the possibility of cooling the sintered component through the mixed austenite/ferrite region.

Unavoidable impurities shall be kept as low as possible, of such elements carbon shall be less than 0.1 wt % as carbon is a very strong austenite stabilizer.

Copper, Cu will enhance the strength and hardness through solid solution hardening. Cu, will also facilitate the formation of sintering necks during sintering as copper melts before the sintering temperature is reached providing so called liquid phase sintering. The powder may optionally be admixed with Cu, preferably in the form of Cu-powder in an amount of 0-3 wt %, and/or other ferrite stabilizing elements such as chromium. In case of chromium the content may be up to 5% by weight of the powder Other substances such as hard phase materials and machinability enhancing agents, such as MnS, $MoS_2$, $CaF_2$, different kinds of minerals etc. may optionally be added to the iron based powder composition.

Feedstock Composition

The feedstock composition is prepared by mixing the iron based powder composition described above and a binder.

The binder in the form of at least one organic binder should be present in the feedstock composition in a concentration of 30-65% by volume, preferably 35-60% by volume, more preferably 40-55% by volume. When using the term binder in the present description also other organic substances that are commonly in MIM-feedstocks are included, such as e.g. releasing agents, lubricants, wetting agents, rheology modifiers, dispersant agents. Examples of suitable organic binders are waxes, polyolefins, such as polyethylenes and polypropylenes, polystyrenes, polyvinyl chloride, polyethylene carbonate, polyethylene glycol, stearic acids and polyoxymethylene.

Sintering

The feedstock composition is moulded into a blank. The obtained blank is then heat treated, or treated in a solvent or by other means to remove one part of the binder as is known in the art, and then further subjected to sintering in a reducing atmosphere in vacuum or in reduced pressure, at a temperature of about 1200-1400° C. in the ferrite area.

Cooling after Sintering

During cooling the sintered component will pass through the two phase area, austenite (FCC)+ferrite (BCC). Therefore grains of austenite will be formed on the grain boundaries of the ferrite grains and grain refinement is obtained. After passing the two phase area, the cooling rate is preferably above 0.2° C./seconds, more preferably above 0.5° C./seconds, in order to avoid grain coarsening. The previously formed austenite grains will be transformed to ferrite having a lower phosphorous content compared to the non-transformed ferrite grains as austenite has lower ability to dissolve phosphorous.

Post Sintering Treatments

The sintered component may be subjected to a heat treatment process, for obtaining desired microstructure, by heat treatment and by controlled cooling rate. The hardening process may include known processes such as quench and temper, case hardening, nitriding, carburizing, nitrocarburizing, carbonitriding, induction hardening and the like. Alternatively a sinter-hardening process at high cooling rate may be utilized.

Other types of post sintering treatments may be utilized such as surface rolling or shot peening which introduces compressive residual stresses enhancing the fatigue life.

Properties of the Finished Component

Sintered components according to the invention reach a sintered density of at least 93% of the theoretical density, and impact strength above 50 J/cm$^2$, tensile strength above 350 MPa, and a ferritic microstructure characterized by containing grains having a higher phosphorous content than the nominal phosphorus content and grains having a phosphorous content lower that the nominal phosphorous content. The grains having lower phosphorous content being formed from transformed austenite grains.

EXAMPLE 1

Five iron based powder compositions with different phosphorus and molybdenum contents were prepared. Compositions A, B, C and E were prepared by mixing an pre-alloyed iron powder having an molybdenum content of about 1.4% by weight with a pure iron powder having an iron content above 99.5% and a $Fe_3P$ powder. The mean particle size of the pre-alloyed iron powder was 37 μm and 99% of all particles had a particle size less than 80 μm. The mean particle size of the pure iron powder was 34 μm and 99% of all particles had a particle size less than 67 μm. The mean particle size of the $Fe_3P$ powder was 8 μm.

Composition D was prepared from the pre-alloyed iron-based powder and the $Fe_3P$ powder only.

In order to simulate the densification behavior during sintering related to the MIM process the compositions were compacted to a density about 4.5 g/cm$^3$ (58% of theoretical density) into standard tensile samples according to SS EN ISO 2740 and thereafter sintered at 1400° C. in an atmosphere of 90% $N_2$/10% $H_2$ by volume, during 60 minutes.

Table 1 shows the test results.

TABLE 1

| | Mo [wt %] | P [wt%] | C [wt%] | wt % Mo + 8 * wt % P | Density [% of theoretical density] |
|---|---|---|---|---|---|
| A | 0.48 | 0.06 | <0.05 | 1.0 | 86.1 |
| B | 0.94 | 0.06 | <0.05 | 1.4 | 90.6 |
| C | 0.94 | 0.11 | <0.05 | 1.8 | 92.3 |
| D | 1.41 | 0.12 | <0.05 | 2.4 | 93.5 |
| E | 0.93 | 0.31 | <0.05 | 3.4 | 94.7 |

Figure 3:
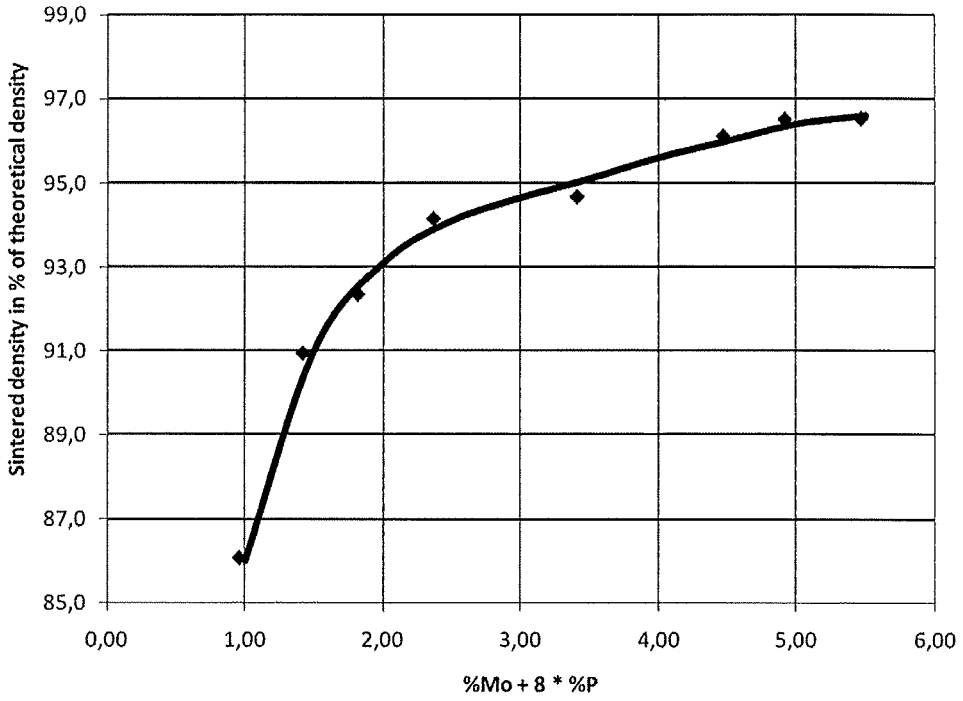
FIG. 3 shows the relation between the sum of % Mo and 8*% P and the sintered density.

In FIG. 3 the relation between the sum of % Mo and 8*% P and the sintered density is traced. From FIG. 3 it is evident that to obtain a sintered density of at least 93% the sum of % Mo and 8*% P must be above 2 and to obtain a sintered density above 94% the sum of % Mo and 8*% P must be above 2.4%.

EXAMPLE 2

The following example illustrates that powder compositions F, G, and H according to one embodiment of the invention will give sintered density of at least 93% of theoretical density. Powder compositions F—H were prepared and tested according to example 1. In composition H only the prealloyed powder and the $Fe_3P$ powder were used. Preparation of compacted samples and sintering was performed according to example 1.

TABLE 2

| | Mo [wt %] | P [wt %] | C [wt %] | Density [% of theoretical density] |
|---|---|---|---|---|
| F | 0.47 | 0.50 | <0.05 | 96.1 |
| G | 0.92 | 0.50 | <0.05 | 96.4 |
| H | 1.39 | 0.49 | <0.05 | 96.5 |

Adding Mo to the alloy will help the densification and increase the sintered density. However if the Mo content is above about 1.5% at a phosphorous content of about 0.5% no increase in density is noticed.

EXAMPLE 3

To increase mechanical properties carbon is often used as an alloying element. A powder composition I from table 3 was sintered in a reducing atmosphere. The sintered density was very poor compared to the corresponding carbon free composition E from
Table 1.

TABLE 3

| | Mo [wt %] | P [wt %] | C [wt %] | Density [% of theoretical density] |
|---|---|---|---|---|
| I | 0.98 | 0.31 | 0.49 | 87.3 |

EXAMPLE 4

Samples of the powder compositions C, E, G and H were prepared according to example 1 and tested with respect to mechanical properties.

The following table 4 shows the test results. Impact strength was tested according to ISO 5754. Tensile test was also performed according to SS EN ISO 2740

TABLE 4

| | Mo [wt %] | P [wt %] | C [wt %] | wt % Mo + 8 * wt % P | Dens [% of theoretical density] | IE [J/cm$^2$] | Tensile strength, Rm [MPa] |
|---|---|---|---|---|---|---|---|
| C | 0.94 | 0.11 | <0.05 | 1.8 | 92.3 | >150 | 331 |
| E | 0.93 | 0.31 | <0.05 | 3.4 | 94.7 | 108 | 395 |
| G | 0.92 | 0.50 | <0.05 | 4.9 | 96.4 | 32 | 458 |
| H | 1.39 | 0.49 | <0.05 | 5.3 | 96.5 | 22 | 480 |

Figure 4:
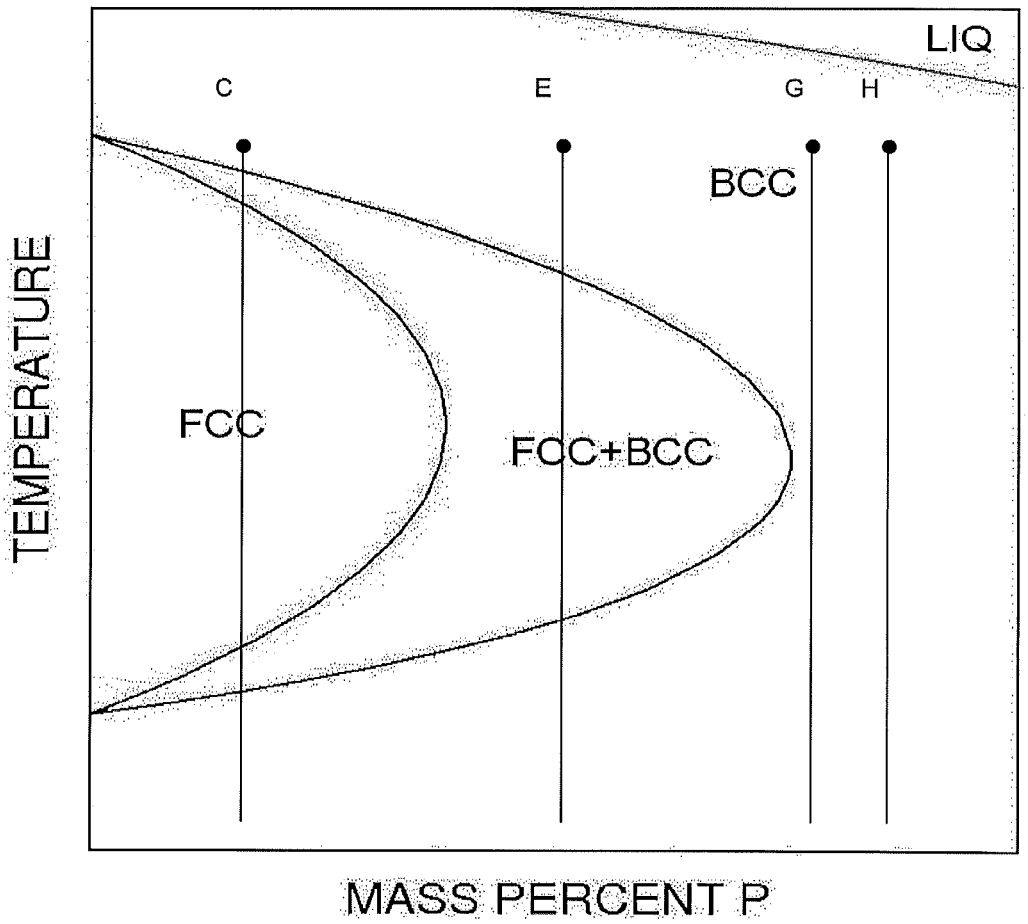
FIG. 4 shows the principal cooling path for the different samples according to example 4.

As can be seen from table 4 high densification is obtained from composition E, G and H, however testing of components from compositions G and H show low impact strength values. At tensile test of sample C tensile strength lower than 350 MPa was obtained FIG. 4 show the principal cooling path for the different samples according to example 4.

EXAMPLE 5

A powder composition X according to table 5 was sintered in a reducing atmosphere. The sintered density was similar to composition E from Table 4. However the tensile strength was increased.

TABLE 5

| | Mo [wt %] | P [wt %] | C [wt %] | Cr [wt %] | wt % Mo + 8 * wt % P | Density [% of theoretical density] | Tensile strength, Rm [MPa] |
|---|---|---|---|---|---|---|---|
| X | 0.49 | 0.35 | <0.05 | 2.6 | 3.3 | 94.6 | 446 |

EXAMPLE 6

A feedstock containing powder composition J was prepared by preparing a powder composition according to example 1 and mixing the powder composition with an organic binder. The organic binder consisted of 47.5% polyethylene, 47.5% paraffin wax and 5% stearic acid. All percentage in weight percentage. The organic binder and the powder compositions were mixed in the ratio 49:51 by volume.

The feedstock was injection moulded into standard MIM tensile bars according to ISO-SS EN ISO 2740 and impact test samples according to ISO 5754. The samples were debinded in hexane for 4 hours at 60° C. to remove the paraffin wax, followed by sintering at 1400° C. in an atmosphere for 90% nitrogen, 10% hydrogen for 60 minutes. Testing was performed according to example 4. The following table 6 shows result from tensile test. For dimensional scatter measurements 5 tensile test samples were used.

TABLE 6

| | Mo [wt %] | P [wt %] | C [wt %] | wt % Mo + 8 * wt % P | Dens [% of theoretical density] | IE [J/cm$^2$] | Tensile strength, Rm [MPa] | Dimensional scatter [%] |
|---|---|---|---|---|---|---|---|---|
| J | 1.01 | 0.29 | <0.05 | 3.33 | 95.1 | 67 | 397 | 0.10 |

As can be seen from table 6 the sintered density and the mechanical properties were very similar to results obtained when testing samples prepared according to example 4, i.e. samples prepared from compaction at 150 MPa. The dimensional scatter was evaluated as the standard deviation of the length of the sintered tensile bars. Despite using relatively coarse metal powder and low content of solids in the feedstock, the dimensional scatter shows a value normally obtained for components produced according to the MIM process.

The invention claimed is:

1. An iron-based powder composition for metal injection molding having an average particle size of 20-60 μm, and having 99% of the particles less than 120 μm wherein the iron-based powder composition comprises by weight percent of the iron-based powder composition:

Mo: 0.3-1.6,
P: 0.1-0.6,
optionally Cu: up to 3.0,
optionally Si: up to 0.6,
Cr: up to 5,
Optionally unavoidable impurities: up to 1.0, whereof carbon is less than 0.1, the balance being iron, and
wherein the sum of Mo and 8*P content is within the range of 2-4.7.

2. An iron-based powder composition according to claim 1 wherein the iron based composition includes an iron powder being prealloyed with Mo in such amounts that the powder composition includes 0.3-1.6% Mo by weight.

3. An iron-based powder composition according to claim 1 wherein P is present in the form of $Fe_3P$ powder.

4. An iron-based powder composition according to claim 1 wherein the content of Mo is 0.35-1.55% by weight of the iron-based powder composition.

5. An iron-based powder composition according to claim 1 wherein the content of P is 0.1-0.45% by weight of the iron-based powder composition.

6. An iron-based powder composition according to claim 2 wherein P is present in the form of $Fe_3P$ powder, wherein the content of Mo is 0.35-1.55% by weight of the iron-based powder composition, wherein the content of P is 0.1-0.45% by weight of the iron-based powder composition.

7. An iron-based powder composition according to claim 1 wherein the content of Mo is 0.40-1.50% by weight of the iron-based powder composition.

8. An iron-based powder composition according to claim 1 wherein the content of P is 0.1-0.40% by weight of the iron-based powder composition.

9. A metal injection molding feedstock composition comprising: the iron based powder composition according to claim 1 and a binder.

10. A metal injection molding feedstock according to claim 9 wherein the binder is at least one organic binder in a concentration of 30-65% by volume of the feedstock composition.

11. A method for producing a sintered component comprising the steps of:

a) preparing a metal injection molding feedstock according to claim 9,
b) molding the feedstock into an unsintered blank,
c) removing the organic binder,
d) sintering the obtained blank in a reducing atmosphere at a temperature between 1200-1400° C.,
e) cooling the sintered component through a two phase area of austenite and ferrite to provide the formation of austenite grains (FCC) at the grain boundaries of the ferrite grains, and
f) optionally subjecting the component to post sintering treatment.

12. A method for producing a sintered component according to claim 11, wherein the post sintering treatment is selected from the group consisting of case hardening, nitriding, carburizing, nitrocarburizing, carbonitriding, induction hardening, surface rolling, shot peening, and mixtures thereof.

13. A sintered component produced according to claim 11 having a density of at least 93% of the theoretical density.

14. A sintered component according to claim 13 having an impact strength above 50 J/cm$^3$ and tensile strength above 350 MPa.

* * * * *